US006392619B1

(12) United States Patent
Nitta et al.

(10) Patent No.: US 6,392,619 B1
(45) Date of Patent: May 21, 2002

(54) DATA TRANSFER DEVICE AND LIQUID CRYSTAL DISPLAY DEVICE

(75) Inventors: Hiroyuki Nitta, Ebina; Atsuhiro Higa, Yokohama; Masashi Nakamura, Takasaki; Satoru Tsunekawa, Higashimurayama; Hirobumi Koshi, Chiba-ken, all of (JP)

(73) Assignees: Hitachi, Ltd., Tokyo; Hitachi Video and Information System, Inc., Yokohama; Hitachi Device Engineering Co., Ltd., Mobara, all of (JP)

( * ) Notice: Subject to any disclaimer, the term of this patent is extended or adjusted under 35 U.S.C. 154(b) by 0 days.

(21) Appl. No.: 09/313,251

(22) Filed: May 18, 1999

(30) Foreign Application Priority Data

May 18, 1998 (JP) ..... 10-135243

(51) Int. Cl.[7] ..... G09G 3/36

(52) U.S. Cl. ..... 345/87; 345/1.2; 345/88; 345/98; 345/100; 345/530; 345/531; 345/534; 345/537; 345/538; 345/564; 345/572; 345/574

(58) Field of Search ..... 345/87, 88, 1.2, 345/537, 538, 98, 100, 530, 531, 534, 564, 572, 574

(56) References Cited

U.S. PATENT DOCUMENTS 4,745,546 A * 5/1988 Grinberg et al. ..... 364/200
4,802,118 A * 1/1989 Honda et al. ..... 364/900
5,032,903 A * 7/1991 Suzuki et al. ..... 358/75
5,034,736 A * 7/1991 Bennett et al. ..... 340/784
5,070,255 A * 12/1991 Shin ..... 307/268
5,153,574 A * 10/1992 Kondo ..... 340/784
5,293,482 A * 3/1994 Lambidakis ..... 395/164
5,559,952 A * 9/1996 Fujimoto ..... 395/164
5,740,376 A * 4/1998 Carson et al. ..... 395/281
5,774,131 A * 6/1998 Kim ..... 345/503

OTHER PUBLICATIONS

"Nikkei Electronics",pp. 133–144 Jun. 8$^{th}$ Issue, 1992 (No. 556), Nikkei BP Corporation.

* cited by examiner

*Primary Examiner*—Richard Hjerpe
*Assistant Examiner*—Jean Lesperance
(74) *Attorney, Agent, or Firm*—Antonelli, Terry, Stout & Kraus, LLP

(57) ABSTRACT

In a data transfer circuit, a hold signal generating circuit generates and outputs a hold signal Hold when transmission data is equal to transmission data one cycle before, and sets a 3-state output buffer for transmission data to high-impedance state, while, in a data reception circuit, when the hold signal Hold is valid, a data reception circuit outputs the reception data held, thereby power consumption in a data bus which is terminated with a terminal resistor is reduced.

20 Claims, 12 Drawing Sheets

DATA TRANSFER DEVICE AND LIQUID CRYSTAL DISPLAY DEVICE

BACKGROUND OF THE INVENTION

1. Field of the Invention

The present invention relates to a data transfer device and a liquid crystal display device, and particularly to a data transfer device and a liquid crystal display using the data transfer device in which a data bus is terminated by a terminal resistor.

2. Description of Related Art

As a conventional data transfer circuit, there is known a data transfer circuit having an input/output interface called GTL (Gunning Transceiver Logic) or CTT (Center Tapped Termination) as disclosed in the June, 8-th issue of 1992 (No. 556) of "Nikkei Electronics", issued by Nikkei BP Corporation, pp. 133–144.

The data transfer circuit has signal amplitude of 1V or less which is effective to increase the data transfer speed and reduce power consumption. That is, in the data transfer circuit, the data bus is terminated by a terminal resistor to reduce the amplitude, thereby suppressing the power consumption of AC components which is represented by the product of the capacitance, the square of the amplitude voltage and the frequency and increasing the operating frequency, so that high-speed data transfer can be implemented.

SUMMARY OF THE INVENTION

As described above, in a conventional data transfer circuit having an input/output interface such as GTL, CTT or the like, data transfer can be implemented at a higher speed and with lower power consumption as compared with a data transfer circuit having full amplitude of a power source voltage by suppressing the power consumption of the AC components. However, in this circuit, power consumption of DC components occurs due to the terminal resistor.

For example, when the termination voltage is set to 1.5V, the signal amplitude voltage of a data signal line is set to ±0.5V with the termination voltage being set at the center thereof and the terminal resistor is set to 50Ω, a constant current of ±10mA flows in the terminating resistor at all times irrespective of high-level or low-level of the signal. Accordingly, data of the same value is continuously transferred, and as a result, even when the substantial frequency velocity of the data is reduced, it is difficult to suppress the power consumption due to the terminal current which flows stationarily.

Therefore, an object of the present invention is to provide a data transfer device and a liquid crystal display device which can reduce the power consumption in a data bus which is terminated by a terminal resistor.

In order to attain the above object, according to a first aspect of the present invention, there is provided a data transfer device having a data transmitter and a data receiver which are connected to each other by a plurality of data signal lines, each data signal line being terminated by a terminal resistor, wherein the data transmitter includes hold signal generating means for generating a hold signal which becomes valid when data to be transmitted are equal to data one cycle before, and stops the data transmission on the basis of the hold signal and transmits the hold signal to the data receiver, and wherein the data receiver includes hold means for holding the data thus received, and stops the reception of the data from the data transmitter on the basis of the hold signal and outputs the data held by the hold means.

According to the first aspect of the present invention, the current flowing in the terminal resistor can be reduced, and thus the power consumption can be reduced.

In the above data transfer device, the hold signal generating means may compare data to be transmitted with data delayed by a predetermined time, and generate the hold signal when these data are coincident with each other. Accordingly, the current flowing in the terminal resistor can be further reduced irrespective of coincidence between the data to be transmitted and the data one cycle before.

Further, in order to attain the above object, according to a second aspect of the present invention, there is provided a liquid crystal display device including a controller and a liquid crystal driving device which are connected to each other by a plurality of data signal lines, and a liquid crystal panel which is driven by the liquid crystal driving device to display information, each of the data signal lines being terminated by a terminal resistor, wherein the controller includes hold signal generating means for generating a hold signal which becomes valid when data to be transmitted are equal to data one cycle before, and stops the data transmission on the basis of the hold signal and transmits the hold signal to the liquid crystal driving device, and wherein the liquid crystal driving device includes hold means for holding data received, and stops reception of the data from the controller on the basis of the hold signal and outputs the data held by the hold means.

According to the second aspect of the present invention, the current flowing in the terminal resistor can be reduced and thus the power consumption can be reduced.

In the above liquid crystal display device, the hold signal generating means may compare data delayed by a predetermined time with data to be transmitted, and generate the hold signal when these data are coincident with each other. Accordingly, the current flowing in the terminal resistor can be reduced irrespective of the coincidence between the transmission data and the data one cycle before.

In the above embodiment, for invalid display data in valid display data and invalid display data, the controller transmits first data and stops transmission of the remaining data to transmit the hold signal to the liquid crystal driving device. Accordingly, the current flowing in the terminal resistor can be reduced during the transmission of the invalid display data.

In the above embodiment, the controller divides the plural data signal lines into plural sets, and a plurality of hold signal generating means are provided in connection with data to be transmitted onto the data signal lines of each set, thereby reducing the current flowing in the terminal resistor of each set.

DETAILED DESCRIPTION OF THE PREFERRED EMBODIMENTS

Figure 1:
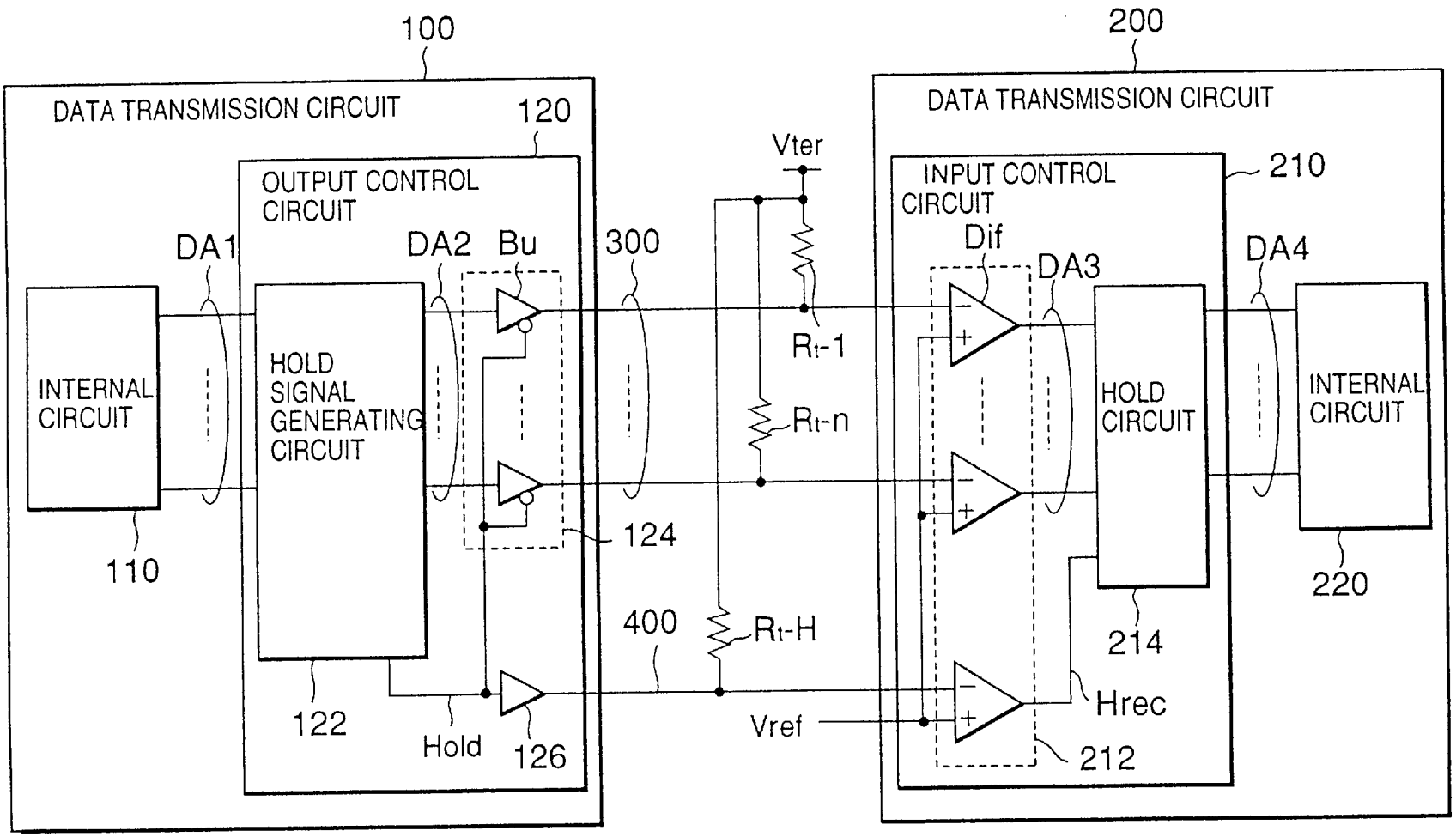
FIG. 1 is a block diagram showing the constitution of a data transfer circuit according to a first embodiment of the present invention.

Preferred embodiment according to the present invention will be described with reference to the accompanying drawings.

The constitution and operation of a data transfer circuit according to a first embodiment of the present invention will be described with reference to FIGS. 1 to 6.

First, the overall constitution of the data transfer circuit according to the first embodiment will be described with reference to FIG. 1.

The data transfer circuit of this embodiment includes a data transmission circuit 100, a data reception circuit 200, data signal lines 300 of n for transferring n-bit data from the data transmission circuit 100 to the data reception circuit 200, a hold signal line 400 for transmitting a hold signal from the data transmission circuit 100 to the data reception circuit 200, and terminal resistors Rt-1 . . . , Rt-n, Rt-H of (n+1) which terminate the data signal lines 300 and the hold signal line 400 by a terminating voltage Vter.

The data transfer circuit 100 includes an internal circuit 110, and an output control circuit 120 for generating external transmission data output from the data signal lines 300 on the basis of internal transmission data DA1 of n bits output from the internal circuit 110, and also generating a hold signal output from the hold signal line 400.

The output control circuit 120 includes a hold signal generating circuit 122 for generating output data DA2 and a hold signal Hold, a data output buffer circuit 124 comprising 3-state output buffers Bu of n which are controlled in a high-impedance state on the basis of the hold signal Hold, and a hold signal output buffer 126. The detailed constitution of the hold signal generating circuit 122 will be described later with reference to FIG. 2.

The data reception circuit 200 includes an input control circuit 210 for restoring the data transmitted from the data signal lines 300 to internal reception data DA4 on the basis of the hold signal, and an internal circuit 220 which is driven on the basis of the internal reception data DA4 thus restored.

The input control circuit 210 includes a differential amplifying circuit 212 comprising differential amplifiers Dif of n for comparing the data input from the data signal lines 300 with a reference voltage Vref to output reception data DA3, and a differential amplifier Dif for comparing the hold signal Hold input from the hold signal line 400 with the reference voltage Vref to output a reception hold signal Hrec, and a hold circuit 214 for holding, in accordance with the reception hold signal Hrec, the reception data DA3 input. The detailed description of the input control circuit 210 will be described later with reference to FIG. 4.

Next, the general operation of the data transfer circuit according to this embodiment will be described.

First, the data transmission operation based on the data transmission circuit 100 will be described.

The internal transmission data DA1 output from the internal circuit 110 in the data transmission circuit 100 is input to the hold signal generating circuit 122 in the output control circuit 120. The hold signal generating circuit 122 generates a hold signal Hold on the basis of the internal transmission data DA1. The detailed constitution and operation of the hold signal generating circuit 122 will be described later with reference to FIGS. 2 and 3.

The hold signal Hold is set to be active when the internal transmission data DA1 is equal to the data value one cycle before. The transmission data DA2 output from the hold signal generating circuit 122 are input to the 3-state output buffers Bu constituting the output buffer circuit 124. The 3-state output buffers Bu output the internal transmission data DA2 to the data signal lines 300. The 3-state output buffers Bu are assumed to be push-pull type buffers.

Since the data signal lines 300 are terminated to the terminal voltage Vter through the terminal resistors Rt-1, . . . , Rt-n, the voltage value of the data signal flowing in the data signal lines 300 is varied with the terminal voltage Vter at the center of the variation. Therefore, the data signal is set to a higher voltage value than the terminal voltage Vter when the transmission data input to the 3-state output buffers Bu is high, and it is set to a lower voltage value than the terminal voltage Vter when the transmission data input to the 3-state output buffers Bu is low. The hold signal Hold is input to the control terminals of the 3-stage output buffers Bu, and when the hold signal Hold is active, the outputs of the 3-state output buffers 124 is set to a high impedance state. That is, the voltage values of the data signal lines 300 are equal to the terminal voltage Vter.

Further, the hold signal Hold is output through the hold signal output buffer 126 to the hold signal line 400. The data transmission operation is carried out as described above.

Next, the data reception operation of the data reception circuit 200 will be described.

The signals from the data signal lines 300 are input to the negative input terminals (−) of the differential amplifiers Dif in the input control circuit 210 of the data reception circuit 200, and the reference voltage Vref is input to the positive input terminals (+) thereof, thereby receiving the transmission data. The differential amplifiers Dif receive the data transmitted through the data signal lines 300 by using the reference voltage Vref as a threshold level, and outputs the inverted data thereof as reception data DA3. At this time, the amplitude of the reception data DA3 is set to the power source voltage level.

The reception data DA3 is input to the hold circuit 214, and the internal hold signal Hrec received in the differential amplifiers Dif is also input to the hold circuit 214. When the hold signal Hrec is active, the hold circuit 214 intercepts the reception data DA3 input, and holds the value. The detailed constitution and operation of the hold circuit 214 will be described later with reference to FIG. 4.

As described above, when the hold signal Hrec is active, the voltage values of the data signal lines 300 are equal to the same voltage value as the terminal voltage Vter. Accordingly, the reception data of the differential amplifiers Dif receiving the data are set to an intermediate level between the high level and the low level. However, the internal reception data DA4 in the data reception circuit 200 are held on the basis of the hold signal Hrec, and thus the internal circuit 220 suffers no effect.

The data transmission/reception can be performed by generating the hold signal and holding the data in accordance with the hold signal.

Next, the constitution and operation of the hold signal generating circuit 122 used in the output control circuit 120 according to this embodiment will be described with reference to FIGS. 2 and 3.

Figure 2:
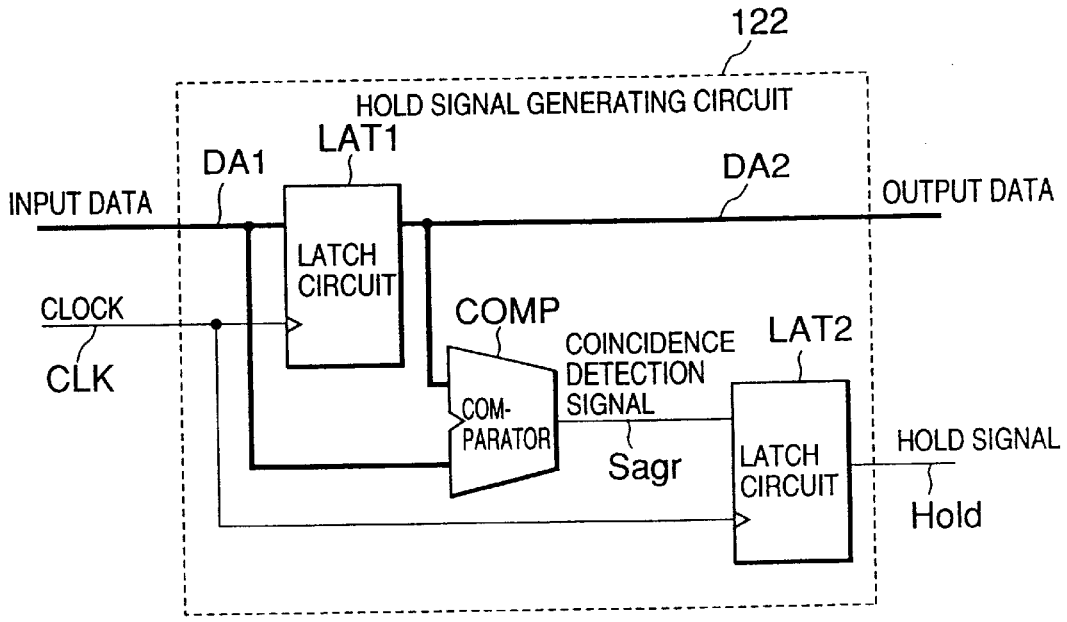
FIG. 2 is a block diagram showing the constitution of a hold signal generating circuit used in an output control circuit constituting the data transfer circuit according to the first embodiment of the present invention.

As shown in FIG. 2, the hold signal generating circuit 122 comprises latch circuits LAT1, LAT2, and a comparator COMP. Although not shown in FIG. 1, the hold signal generating circuit 122 is supplied with a clock CLK to latch the data.

The internal transmission data DA1 (hereinafter referred to as "input data") is input to the latch circuit LAT1, and latched by the clock CLK, whereby the transmission data DA2 which are delayed by one cycle (hereinafter referred to as "output data") are output from the latch circuit LAT1. That is, as shown in FIGS. 3(B) and 3(C), the input data D1 input to the latch circuit LAT1 are output as output data from the latch circuit LAT1 at the timing of cycle 1 which is delayed by one cycle.

The input data and the output data are input to the comparator COMP. The comparator COMP makes a coincidence detection signal Sagr when the input data and the output data are coincident with each other, that is, the same data is continued over two cycles. For example, in the case of (B) of FIG. 3, it is assumed that each of the input data D1, D2 varies every cycle, however, the input data D3 is invariable over three cycles from the cycle 2 to the cycle 4. At this time, the input data and the output data are coincident with each other in the cycle 3 and the cycle 4, and as shown in (D) of FIG. 3, the coincidence detection signal Sagr which is the output of the comparator COMP becomes active (set to high level). Likewise, assuming that the input data D5 are invariable in cycle 6 and subsequent cycles, the input data and the output data are coincident with each other in cycle 7 and subsequent cycles. At this time, the coincidence detection signal Sagr which is output of the comparator COMP is active (set to high level) as shown in (D) of FIG. 3.

The coincidence detection signal Sagr is latched by the latch circuit LAT2, and output as the hold signal Hold. As shown in (E) of FIG. 3, the hold signal Hold is delayed with respect to the coincidence detection signal Sagr by one cycle.

As described above, the hold signal generating circuit 122 generates the transmission data DA2 and the hold signal Hold.

In the foregoing description, the input data is delayed by one cycle in the latch circuit LAT1 to generate the output data. However, even when the input data is directly used as the output data and the coincidence detection signal Sagr is directly used as the hold signal Hold, there would be no problem if the hold signal Hold is validated from the second cycle of the data in which the same data is continued over plural cycles.

Next, the detailed constitution and operation as the input control circuit 210 according to this embodiment will be described with reference to FIG. 4.

The differential amplifying circuit 212 of the input control circuit 210 comprises differential amplifiers Dif-1, . . . , Dif-n of n which compare the data input from the data signal lines 300 with the reference voltage Vref to output the reception data DA3, and a differential amplifier Dif-H for comparing the hold signal Hold input from the hold signal line 400 with the reference voltage Vref to output a reception hold signal Hrec.

The hold circuit 214 comprises data latch units DL-1, . . . , DL-n of n to which the reception data is input, and inverters INV1, INV2 which are supplied with the reception hold signal Hrec and connected to each other in series. The data latch units DL-1, . . . , DL-n have the same constitution, and in the following description, the constitution of the data latch unit DL-1 will be described.

The data latch unit DL-1 comprises a switch SW-1, an inverter INV-1 and a clocked inverter CI-1. The clocked inverter CI-1 is an inverter circuit whose output can be subjected to high-impedance control by connecting/interrupting the power source thereto/therefrom on the basis of a latch signal SLA output from the inverter INV1, INV2. The output of the inverter INV-1 is input to the clocked inverter CI-1, and the inverted output thereof is connected to the input side of the inverter INV-1 to form a feedback loop, thereby constructing the data latch unit DL1.

Next, the operation of the input control circuit 210 will be described.

The data of the data signal lines 300 and the reference voltage Vref are input to the differential amplifiers Dif-1, . . . , Dif-n constituting the differential amplifying circuit 212. The differential amplifiers Dif-1, . . . , Dif-n output the reception data DA3 which is the inverted data of the data signal lines 300, and input the reception data DA3 to the hold circuit 214.

The reception data DA3 is input to the inverters INV-1, . . . , INV-n through switches SW-1, . . . , SW-n. The inverters INV-1, . . . , INV-n output the internal reception data DA4. The internal reception data DA4 is input to the clocked inverters CI-1, . . . , CI-n whose outputs can be subjected to high-impedance control by connecting/interrupting the power source thereto/therefrom. The clocked inverters CI-1, . . . , CI-n input the inverted outputs to the inverters INV-1, . . . , INV-n, thereby forming a feedback loop and constructing the latch circuit.

The hold circuit 214 is supplied with the internal hold signal Hrec which is inverted through the differential amplifier Dif-H as in the case of the data signal lines 300, and the latch signal SLA is generated through the inverters INV1, INV2.

When the hold signal line 400 is inactive, the switches SW-1, . . . , SW-n are on, and the reception data DA3 is input thereto. Further, the clocked inverters CI-1, . . . , CI-n sets the outputs thereof to high-impedance state, whereby the inverters INV-1, . . . , INV-n output the reception data DA3 as the internal reception data DA4. That is, the data latch units DL-1, . . . , DL-n pass the reception data DA3 as the internal reception data DA4 therethrough with no modification.

On the other hand, when the hold signal line 400 is active, the switches SW-1, . . . , SW-n are off, and the reception data DA3 is interrupted. The clocked inverters CI-1, . . . , CI-n inverts the outputs of the inverters INV-1, . . . , INV-n and outputs the inverted outputs, whereby the value is held in the feedback loop and the internal reception data DA4 is output. That is, the data latch units DL-1, DL-n latch the data. At this time, the reception data DA3 output from the differential amplifying circuit 212 is interrupted by the switches SW-1, . . . , SW-n, and thus the data signal lines 300 are set to the level of the terminal voltage Vter. Therefore, even when the voltage value of the reception data DA3 varies, it has no effect on the internal reception data DA4 output from the hold circuit 214.

As described above, the reception data DA4 is held by using the hold signal Hrec, whereby the data signal lines 300 can be set to the terminal voltage Vter level.

Here, the data which is transmitted from the data transmission circuit and received by the data reception circuit in the data transfer circuit according to this embodiment will be described with reference to FIGS. 5 and 6.

Figure 5:
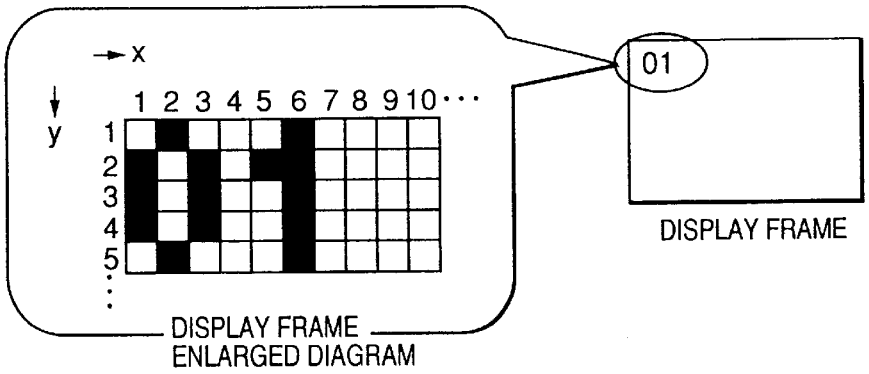
FIG. 5 is an explanatory diagram showing a dot-matrix type display frame on which text data is displayed.
Figure 6:
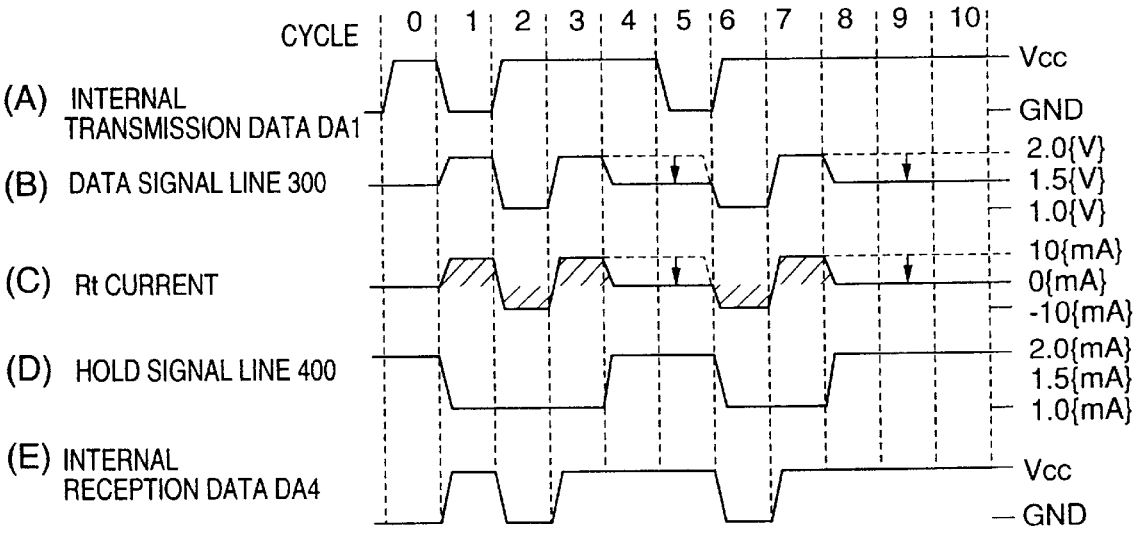
FIG. 6 is a timing chart showing a data transfer operation of display data of one line on the display frame when data is transmitted/received by using the data transfer circuit according to the first embodiment of the present invention.

FIG. 5 shows an example of a dot matrix type display frame on which text data is displayed d, and FIG. 6 shows a data transfer timing of display data of a first line of the display frame using the data transfer circuit according to this embodiment.

FIG. 5 shows a case where numerals "01" are displayed on the display frame, and a character line is constructed by 5 lines in the y-direction as shown in the magnification of the display frame. Here, the data in the x-direction of the first line correspond to "1011101111 . . . " if white is represented by data of "high level=1" and black is represented by data of "low level=0".

(A) of FIG. 6 shows the internal transmission data DA1 output from the internal circuit 110 of the data transmission circuit 100 to display the first line shown in FIG. 5.

The signals flowing in the data signal lines 300 shown in (B) of FIG. 6 are equal to the output data DA2 described with reference to (C) of FIG. 3, and correspond to the signals obtained by delaying the internal transmission data DA1 by one cycle. In (B) of FIG. 6, a solid line represents data waveform in this embodiment, and a broken line represents data waveform of the prior art for reference.

Here, in the case of FIG. 6, the terminal voltage Vter is set to 1.5V, the data flowing in the data signal lines 300 and the hold signal line 400 are set to have an amplitude range of ±0.5V with the center of the range being set to 1.5V. That is, since the data signal lines 300 are terminated to the terminal voltage Vter through the terminal resistors Rt-1, . . . , Rt-n, the voltage values of the data signals flowing in the data signal lines 300 are varied with the terminal voltage Vter at the center of the variation, and these values are set to a higher voltage value (2.0V) than the terminal voltage Vter when the transmission data input to the 3-state output buffers Bu are high while these values are set to a lower voltage value (1.0V) when the transmission data is low.

Figure 3:
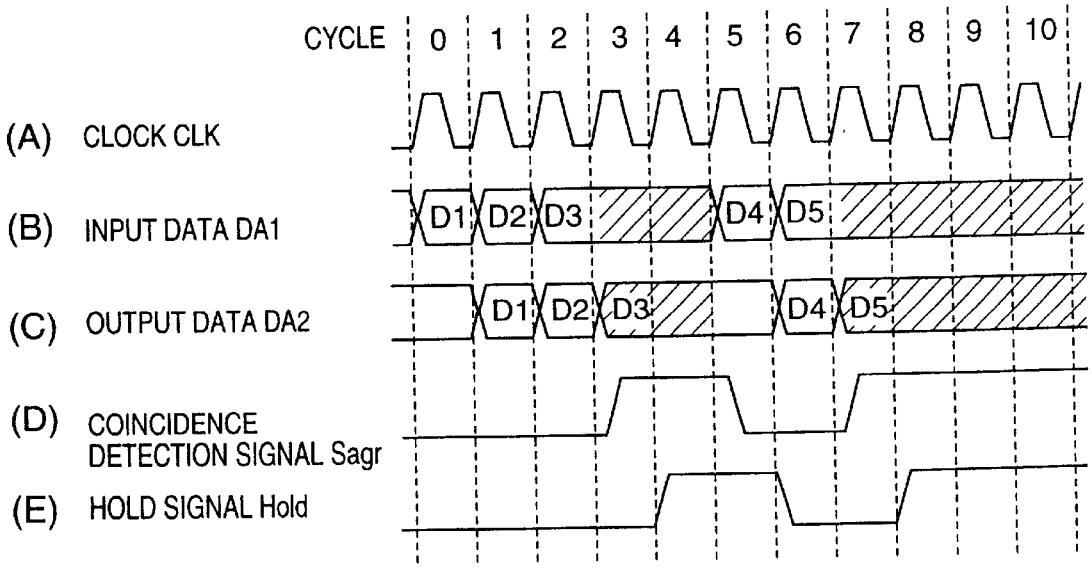
FIG. 3 is a timing chart showing the operation of the hold signal generating circuit used in the output control circuit constituting the data transfer circuit according to the first embodiment of the present invention.

In the cycles 4, 5, the hold signal generating circuit 122 shown in (E) of FIG. 3 generates the hold signal Hold shown in (D) of FIG. 6. The hold signal Hold is input to the control terminals of the 3-state output buffers Bu as shown in FIG. 1. Here, when the hold signal Hold is active, the outputs of the 3-state output buffers Bu are set to the high impedance state. That is, the voltage values of the data signal lines 300 are equal to the terminal voltage Vter. Accordingly, according to this embodiment, the voltage of the signals of the data signal lines 300 is equal to the terminal voltage Vter (1.5V) in the cycles 4, 5. Likewise, the voltage of the signal of the data signal line 300 is also equal to the terminal voltage Vter (1.5V) during the cycles 8 to 10. In the conventional system, the voltage of the signal of the data signal line 300 is set to high level during the cycles 4, 5, 8 to 10.

(C) of FIG. 6 shows the current flowing in the terminal resistor Rt. The Rt current is set to plus current (for example, +10 mA) when the signal flowing in the data signal line 300 is in high level, and it is set to minus level (for example, −10 mA) when the signal flowing in the data signal line 300 is in low level. Further, when the 3-state output buffer Bu is used as the output buffer and the output of the 3-state output buffer Bu is set to the high impedance state by the control input thereto like this embodiment, the Rt current is equal to zero (0 mA). That is, as shown in (C) of FIG. 6, the Rt current can be reduced from +10 mA (in the prior art) to 0 mA in the cycles 4, 5, 8 to 10. The power consumption can be reduced by the above current reduction.

Next, the operation at the reception time will be described with reference to (E) of FIG. 6.

Figure 4:
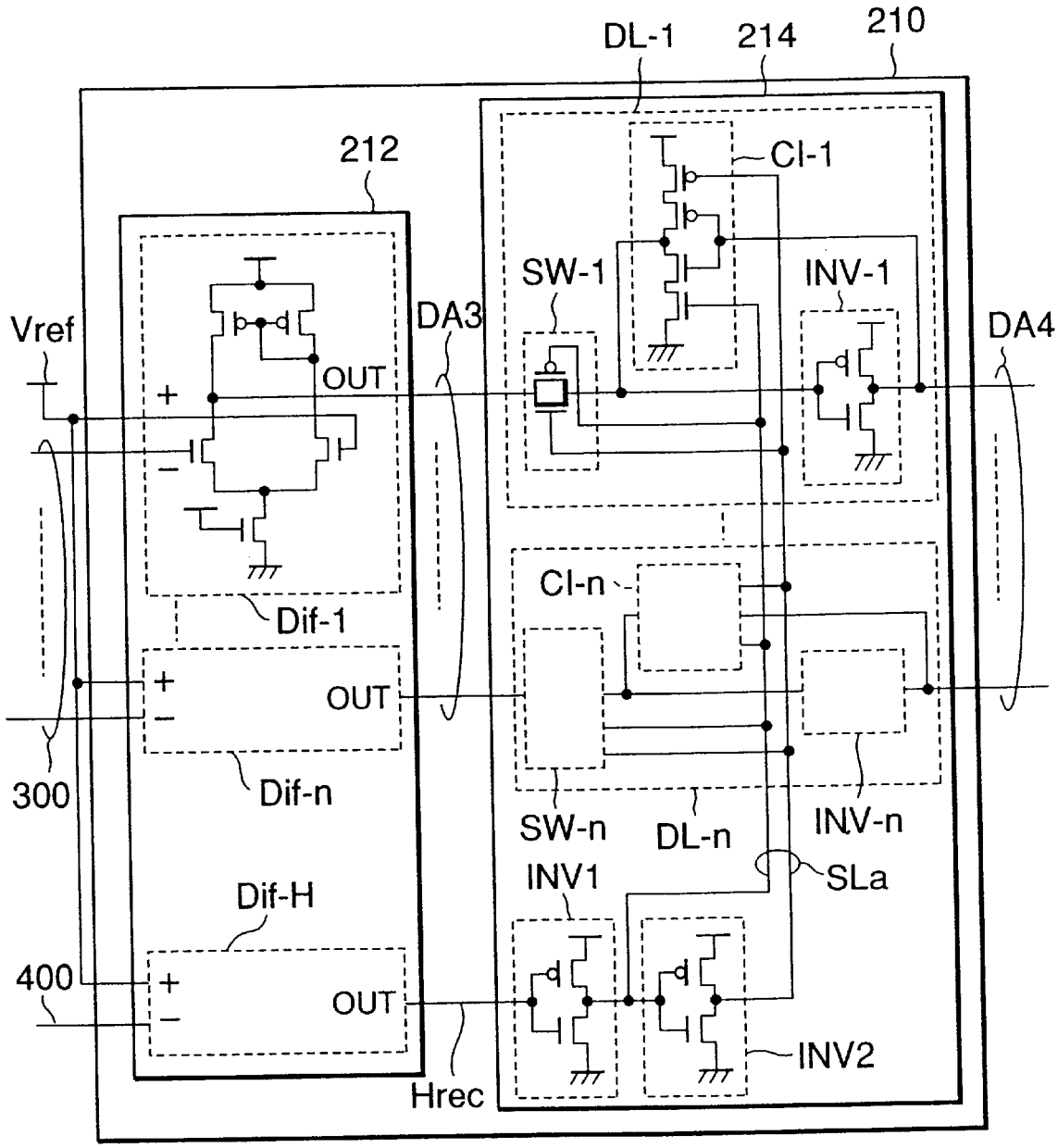
FIG. 4 is a block diagram showing the constitution of an input control circuit used in the data transfer circuit according to the first embodiment of the present invention.

In the cycles 1 to 3, the switches SW-1, . . . , SW-n shown in FIG. 4 are on, and the data flowing in the data signal lines 300 ((B) of FIG. 6) is directly output as the internal reception data DA4 from the input control circuit 210. The internal reception data DA4 has an amplitude between high potential Vcc and low potential GND.

On the other hand, in the cycles 4 and 5, the switches SW-1, . . . , SW-n are off. The internal reception data DA4 is set to the level of the previous cycle which is latched by the data latch units DL-1, . . . , DL-n. Likewise, in the cycles 8 to 10, the internal reception data DA4 is set to the level of the previous cycle.

Here, the internal transmission data DA1 of (A) of FIG. 6 and the internal reception data DA4 of (E) of FIG. 6 are equal to each other except that the internal reception data DA4 of (E) of FIG. 6 is delayed from the internal transmission data DA1 of (A) of FIG. 6 by one cycle. That is, in this embodiment, when the same data is continued, the power consumption is reduced by setting the Rt current to zero.

In the conventional data transmission circuit, the number of data signal lines 300 is set to N when N-bit data is transferred. In this embodiment, one hold signal line 400 is added, and thus the number of required signal lines is equal to (N+1). In consideration of the current flowing in the hold signal line 400, the power consumption reducing effect will be described below.

That is, Rt current of (N+1)×10 mA flows in the cycles 1 to 3, however, Rt current of 1×10 mA flows in the cycles 4, 5. The sum of the current flowing in all the cycles is divided by the number of cycles to calculate the current per time flowing in the cycles 1 to 10 (=(0.5×N +1)×10 mA).

In the conventional data transfer circuit, the current of N×10 mA flows stationarily. Therefore, if N is equal to 3 or more, the Rt current per unit flowing in the cycles 1 to 10 can be reduced more greatly in the data transfer circuit of this embodiment as compared with the conventional data transfer circuit. For example, in the cycles 1 to 10 shown in FIG. 6, in a case of N=10, the power consumption in this embodiment can be reduced up to 60% of that of the conventional data transfer circuit. Further, when a larger amount of same data is continued, the Rt current can be reduced more greatly as compared with the prior art.

As described above, the power consumption of the terminal resistor Rt can be reduced in the data transfer circuit of this embodiment. Particularly, the data transmission circuit of this embodiment is effective to the data transfer of text images, computer graphic images, etc. for which the same data is continuously transferred.

Next, a data transfer circuit according to a second embodiment of the present invention will be described with reference to FIGS. 7 to 9.

Figure 7:
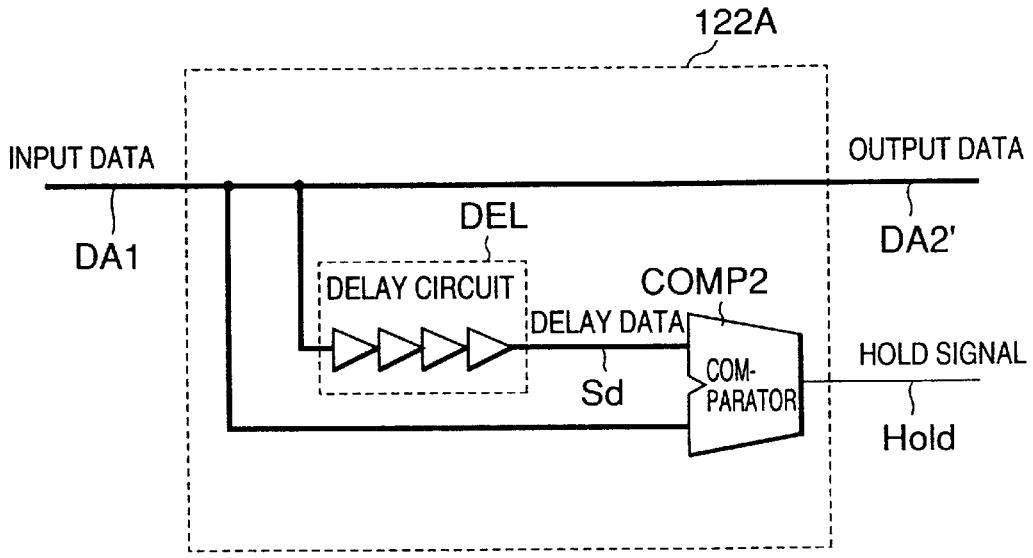
FIG. 7 is a block diagram showing the constitution of the hold signal generating circuit used in the output control circuit of the data transfer circuit according to a second embodiment of the present invention.
Figure 8:
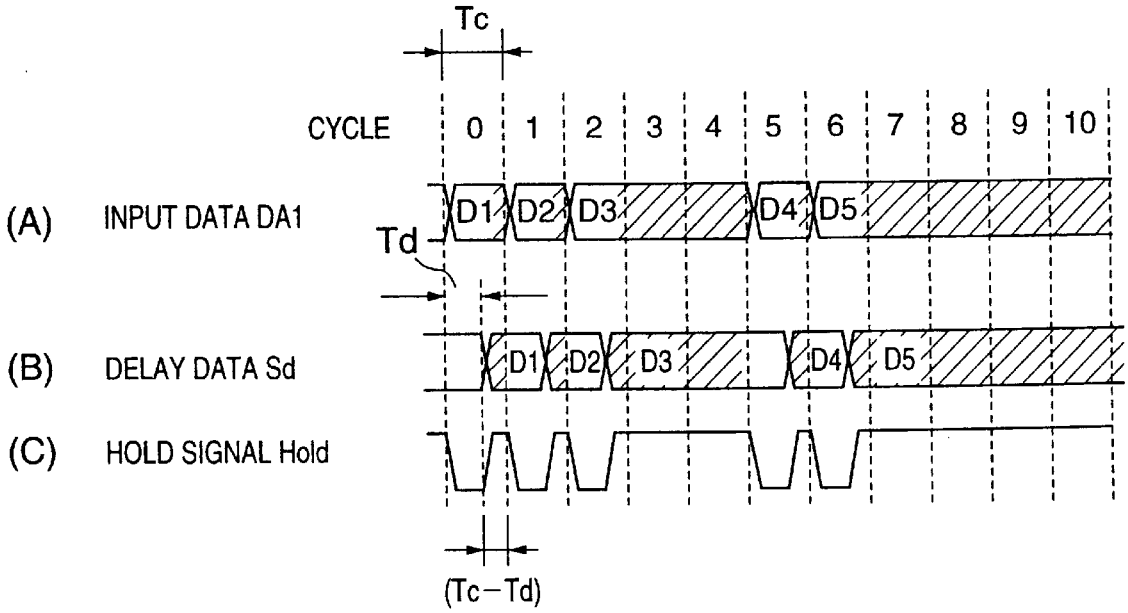
FIG. 8 is a timing chart showing the operation of the hold signal generating circuit according to the second embodiment of the present invention.
Figure 9:
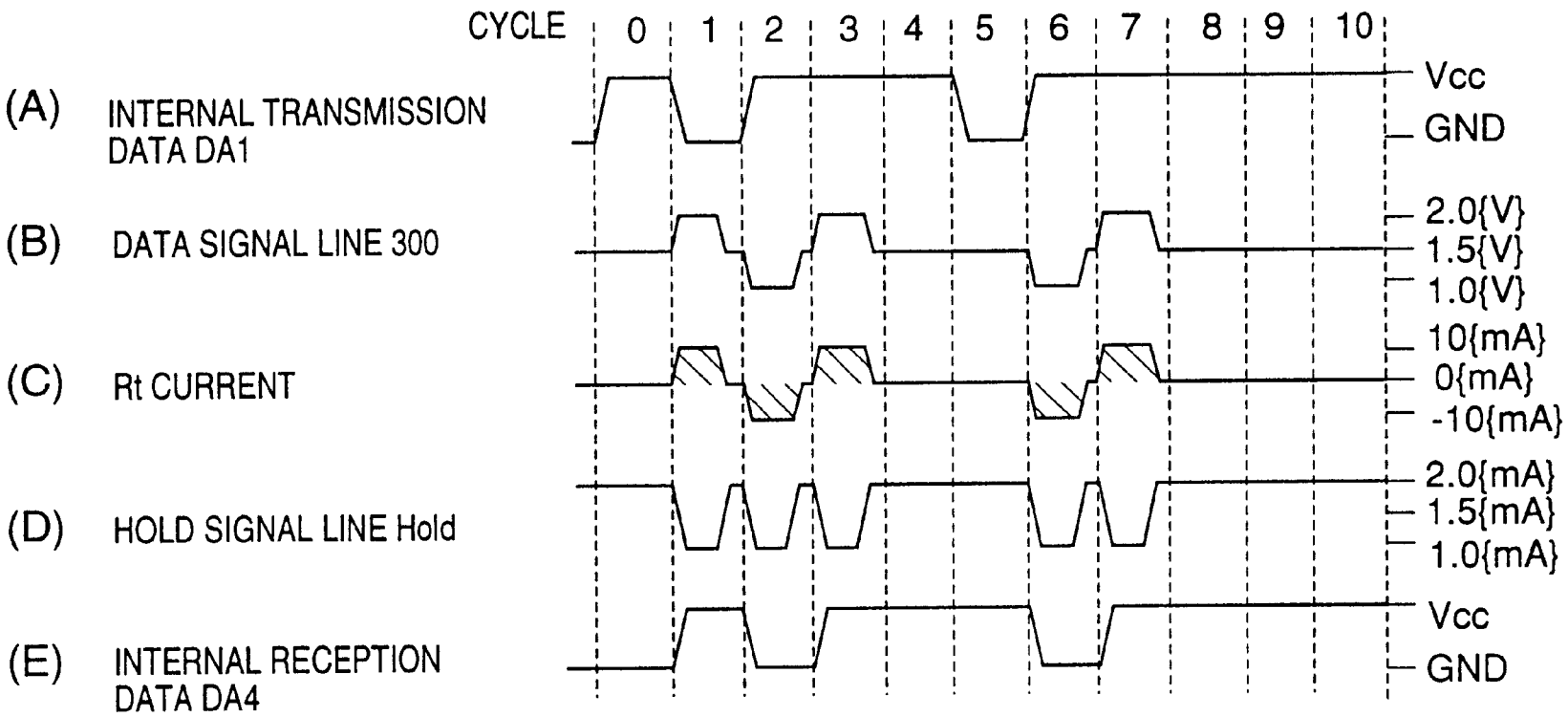
FIG. 9 is a timing chart showing the data transfer operation of the data transfer circuit according to the second embodiment of the present invention.

FIG. 7 shows the constitution of the hold signal generating circuit using the output control circuit of the data transfer circuit according to this embodiment, FIG. 8 shows the operation of the hold signal generating circuit of this embodiment and FIG. 9 shows the data transfer timing of the data transfer circuit according to this embodiment.

First, the constitution of the hold signal generating circuit using the output control circuit of the data transfer circuit according to this embodiment will be described with reference to FIG. 7.

The overall constitution of the data transfer circuit according to this embodiment is the same as the data transfer circuit having the data transmission circuit 100, the data reception circuit 200, the data signal lines 300 and the hold signal line 400 shown in FIG. 1. The constitution of the hold signal generating circuit is partially different from that of the hold signal generating circuit 122 shown in FIG. 2.

In t his embodiment, as in the case of the first embodiment described with reference to FIGS. 1 to 6, in the data transmission circuit the data transmission is held when the data to be transmitted is equal to the data one cycle before, and in the data reception circuit the data is restored on the basis of the hold signal thus transmitted. In this embodiment, the power consumption can be more reduced as compared with the first embodiment.

As shown in FIG. 7, the hold signal generating circuit 122A has a delay circuit DEL and a comparator COMP2. The delay time Td based on the delay circuit DEL is set to be shorter than the one-cycle time. For example, if one cycle is set to 30 ns, the delay time Td is set to 10 ns to 20 ns.

The internal transmission data DA1 (hereinafter referred to as "input data") is directly output as transmission data DA2' (hereinafter referred to as "output data"). The input data DA1 is input to the delay circuit DEL to be delayed by the delay time Td, and then output as delay data Sd. Thereafter, the delay data Sd is input to one input terminal of the comparator COMP2. Further, the input data DA1 is directly input to the other input terminal of the comparator COMP2. The comparator COMP2 makes the hold signal active when the two input data (the input data DA1 and the delay data Sd) are coincident with each other.

For example, in the case of FIG. 8, (A) shows the same input data DA1 as shown in (B) of FIG. 3. The delay data Sd is delayed by the delay time Td with respect to the input data DA1 as shown in (B) of FIG. 8. Here, in the cycles 3, 4, 7 to 10, both of the data are coincident with each other. Accordingly, at this time the hold signal Hold output from the comparator COMP2 becomes active (set to high level).

Further, in the cycle 0, if the length of the cycle is set to Tc, both of the data are coincident with each other during the second half time (Tc-Td). Accordingly, as shown in (C) of FIG. 8, the hold signal Hold output from the comparator COMP2 is active (in high-level state) during the second half time (Tc-Td) of the cycle 0.

Likewise, the hold signal Hold output from the comparator COMP2 is also active (in high level) during the second half time (Tc-Td) in the cycles 1, 2, 5, 6.

Here, the hold circuit 214 of the input control circuit 210 shown in FIG. 4 needs a setup time for holding the data value in the data latch portion DL at the leading edge of the hold signal Hrec. Therefore, the delay time Td is required to be set to be equal to or longer than the setup time.

Next, the data which is transmitted from the data transmission circuit and received by the data reception circuit in the data transfer circuit according to this embodiment will be described with reference to FIG. 9.

(A) of FIG. 9 shows the internal transmission data DA1 output from the internal circuit 110 of the data transmission circuit 100 shown in FIG. 1 to display the first line shown in FIG. 5. That is, (A) of FIG. 9 is identical to (A) of FIG. 6.

The signal flowing in the data signal line 300 shown in (B) of FIG. 9 has such a waveform that the internal transmission data DA1 is delayed by one cycle. However, when the hold signal Hold shown in (D) of FIG. 9 is active, the output of the 3-state output buffer Bu is set to high-impedance, so that the voltage value of the data signal line 300 at this time is equal to the terminal voltage Vter.

Accordingly, in a part of each of the cycles 1, 2, 3, 6, 7 (corresponding to the time (Tc-Td)) and in each of the cycles 4, 5, 8 to 10, the signal voltage of the data signal line 300 is equal to the terminal voltage Vter (1.5V).

(C) of FIG. 9 shows the current flowing in the terminal resistor Rt. When the output of the 3-state output buffer Bu is set to high impedance by the hold signal which is the control input of the 3-state output buffer Bu, the Rt current is equal to zero (0 mA). That is, as shown in (C) of FIG. 9, the Rt current can be reduced to 0 mA in the part of each of the cycles 1, 2, 3, 6, 7 (corresponding to the time (Tc-Td)) and in each of the cycles 4, 5, 8 to 10. The reduction of the above current also reduces the power consumption.

Further, describing the operation at the reception time with reference to (E) of FIG. 9, the data flowing in the data signal line 300 are directly output as the internal reception data DA4 from the input control circuit 210 during the time period for which the switches SW-1, . . . , Sw-n shown in FIG. 4 are on (the time period for which the hold signal is in the low level).

On the other hand, when the hold signal becomes active and the switches SW-1, . . . , SW-n are set to be off, the internal reception data DA4 is set to the level latched by the data latch units DL-1, . . . , DL-n.

Here, the internal transmission data DA1 of (A) of FIG. 9 and the internal reception data DA4 of (E) of FIG. 9 are equal to each other except that the data DA4 is delayed from the data DA1 by one cycle. That is, in this embodiment, when the same data is continued, the Rt current is controlled to be equal to zero, thereby reducing the power consumption.

Accordingly, according to this embodiment, in addition to the RT current reducing effect of the first embodiment shown in FIGS. 1 to 6, the Rt current can be further reduced by the amount of the hold signal (the time: (Tc-Td)) generated on the basis of the delay time Td. For example, under the following condition: N=10, cycle time Tc=30 ns and delay time Td=10 ns in the cycles 1 to 10 shown in FIG. 6, the power consumption of this embodiment can be reduced to 43% of that of the conventional data transfer circuit.

As described above, in the data transfer circuit of this embodiment, the power consumption of the terminal resistor Rt can be reduced, and thus the data transfer circuit of this embodiment is particularly effective to the data transfer of text images, computer graphic images, etc. for which the same data is continuously transferred.

Next, the data transfer circuit according to a third embodiment of the present invention will be described with reference to FIG. 10.

The overall constitution of the data transfer circuit of this embodiment is the same as the data transfer circuit including the data transmission circuit 100, the data transfer circuit reception circuit 200, the data signal lines 300 and the hold signal line 400 except that the constitution of the input control circuit of this embodiment is partially different from that of the input control circuit 210 shown in FIG. 2.

In this embodiment, when the data to be transmitted is equal to the data one cycle before, the data transmission is held in the data transmission circuit, and the data is restored on the basis of the transmitted hold signal in the data reception circuit as in the case of the first embodiment described with reference to FIGS. 1 to 6.

Figure 10:
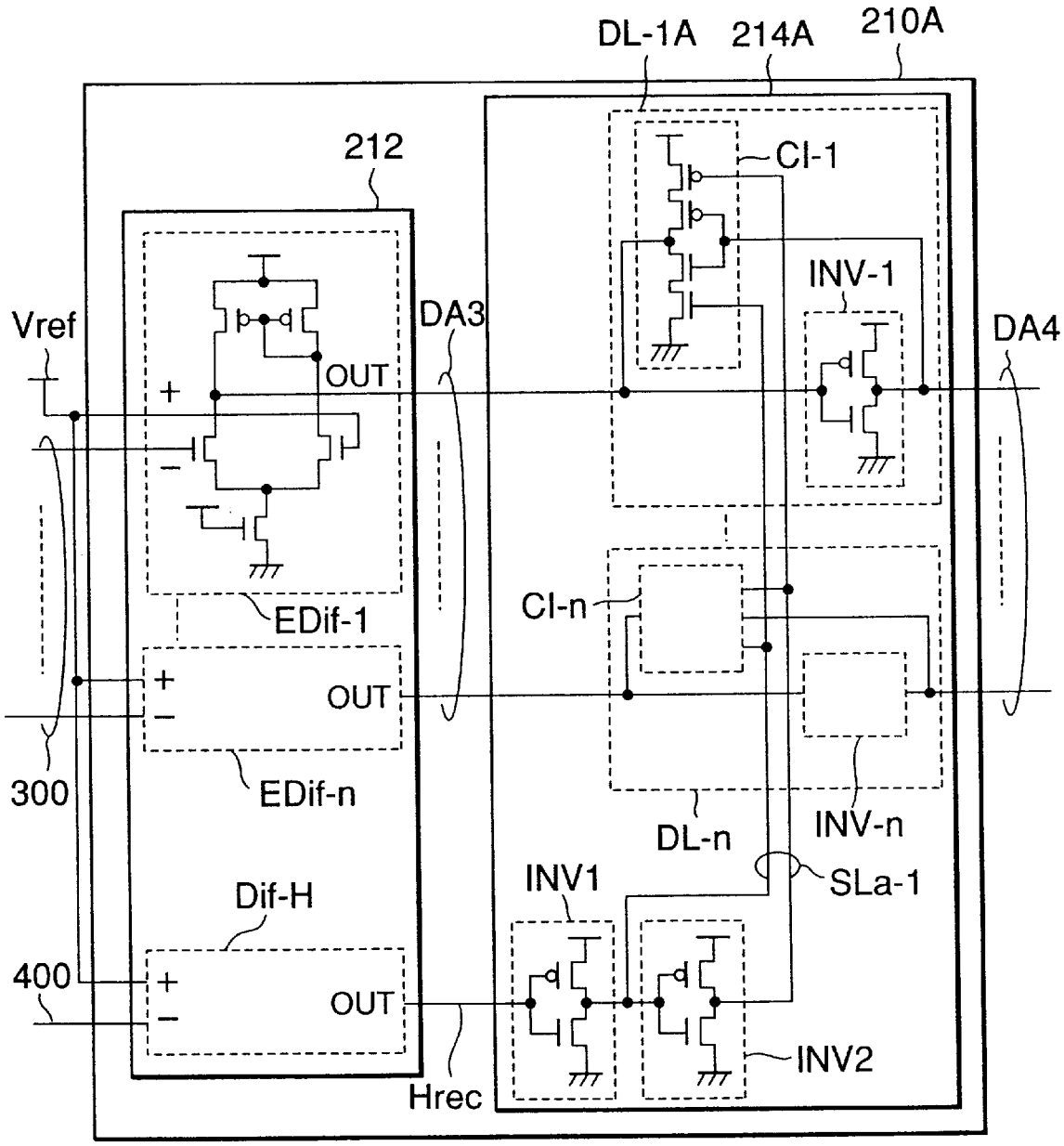
FIG. 10 is a block diagram showing the constitution of an input control circuit of a data transfer circuit according to a third embodiment of the present invention.

FIG. 10 is a block diagram showing the constitution of the input control circuit of the data transfer circuit according to the third embodiment. In FIG. 10, the same numerals as those in FIG. 4 represent the same portions.

In the input control circuit 210 shown in FIG. 4, the reception data DA3 which is the output of the differential amplifier Dif are interrupted by the switches SW-1, . . . , SW-n of the hold circuit 214 to form a feedback loop, thereby holding the data value. On the other hand, in the input control circuit 210A of this embodiment, differential amplifiers EDif-1, . . . , EDif-n each having an enable terminal are used in place of the differential amplifiers Dif-1, . . . , Dif-n and the switches SW-1, . . . , SW-n.

The differential amplifying circuit 212A of the input control circuit 210A includes differential amplifiers Edif-1, . . . , Edif-n of n for comparing the data input from the data signal lines 300 with the reference voltage Vref to output the reception data DA3, and a differential amplifier Dif-H for comparing the hold signal Hold input from the hold signal line 400 with the reference voltage Vref to output the reception hold signal Hrec.

Each of the differential amplifiers EDif-1, . . . , EDif-n is, although not shown in FIG. 10, a differential amplifier having an enable terminal EN.

The hold circuit 214A includes data latch units DL-1, . . . , DL-n of n to which reception data is input, and inverters INV1, INV2 which are connected to each other in series and to which the reception hold signal Hrec is input.

The data latch units DL-1, . . . , DL-n have the same constitution. In the following description, the constitution of the data latch unit DL-1 will be representatively described.

The data latch unit DL-1 includes an inverter INV-1 and a clocked inverter CI-1. The clocked inverter CI-1 is an inverter circuit which can connect or interrupt the power source on the basis of the latch signal SLA output from the inverter INV1, INV2 to thereby perform the high-impedance control on the output thereof. The output of the inverter INV-1 is input to the clocked inverter CI-1. The clocked inverter CI-1 inverts the input thereto and outputs the data thus inverted to the inverter INV-1, whereby a feedback loop is formed to construct the data latch unit DL-1.

Next, the operation of the input control circuit 210A will be described.

The differential amplifiers Dif-1, . . . , Dif-n constituting the differential amplifying circuit 212A are supplied with the data of the data signal lines 300 and the reference voltage Vref. The differential amplifiers Dif-1, . . . , Dif-n output the reception data DA3 obtained by inverting the data of the data signal lines 300, and input the reception data DA3 to the hold circuit 214A.

The reception data DA3 is input to the inverters INV-1, . . . , INV-n. The inverters INV-1, . . . , INV-n output the reception data DA3 input thereto as internal reception data DA4. The internal reception data DA4 is input to the clocked inverters CI-1, . . . , CI-n whose output can be subjected to the high-impedance control by connecting or interrupting the power source. The clocked inverters CI-1, . . . , CI-n invert the internal reception data DA4 and output the inverted data to the inverters INV-1, . . . , INV-n, whereby the feedback loop is formed to construct the latch circuit.

The hold circuit 214A is supplied with the internal hold signal Hrec which is inverted through the differential amplifier Dif-H as in the case of the data signal lines 300, whereby the latch signal SLA is formed through the inverters INV1, INV2.

Although not shown in FIG. 10, each of the differential amplifier Dif-1, . . . , Dif-n is provided with a circuit for connecting or interrupting the power source by an enable terminal EN thereof, and connects the latch signal output from the inverter INV1 of the hold circuit 214A to the enable terminal EN, whereby the power source is interrupted when the internal hold signal Hrec is active.

When the internal hold signal Hrec is active, the differential amplifier Dif-1 , . . . , Dif-n stops its operation and sets the output terminal to high-impedance state. At this time, the clocked inverter CI-1, . . . , CI-n form the feedback loop for outputting the data thus held, thereby holding the reception data.

As described above, the reception data DA4 is held by using the hold signal Hrec to set the data signal lines 300 to the terminal voltage Vter level. Further, the operation of the differential amplifiers Dif-1, . . . , Dif-n can be stopped during the period for which the hold signal Hrec is active, and the power consumption of the differential amplifiers can be reduced.

As described above, the data transfer circuit of this embodiment can reduce the current consumption of the terminal resistor Rt, and is particularly effective to data transfer of text images, computer graphic images, etc. for which the same data is continuously transferred.

Further, the operation of the differential amplifiers Dif-1, . . . , Dif-n can be stopped during the time period for which the hold signal Hrec is active, and the power consumption of the differential amplifiers can be reduced.

Next, the constitution and operation of a liquid crystal display device using a data transfer circuit according to a fourth embodiment of the present invention will be described with reference to FIGS. 11 and 12.

Figure 11:
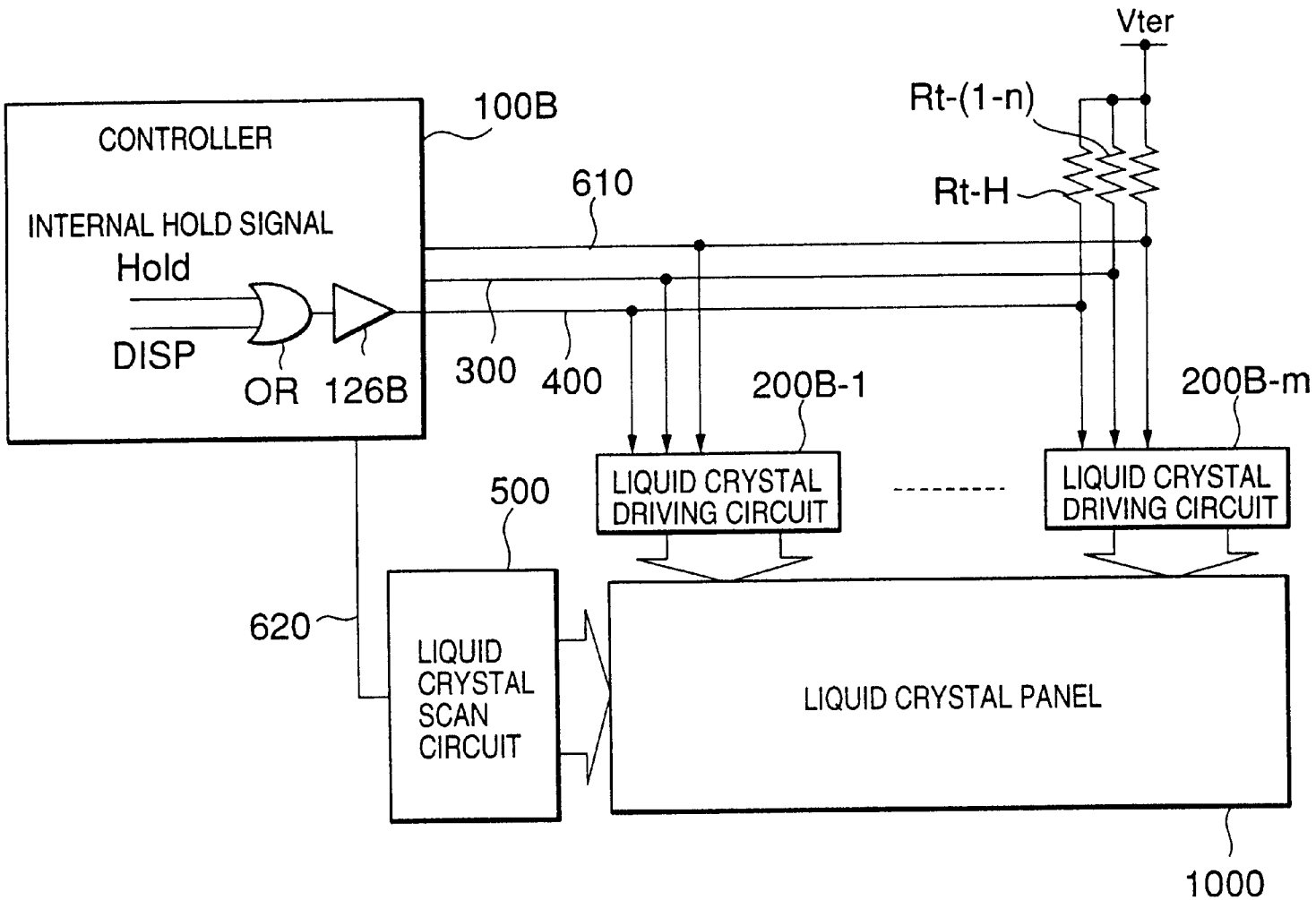
FIG. 11 is a block diagram showing the constitution of a liquid crystal display device using a data transfer circuit according to a fourth embodiment of the present invention.
Figure 12:
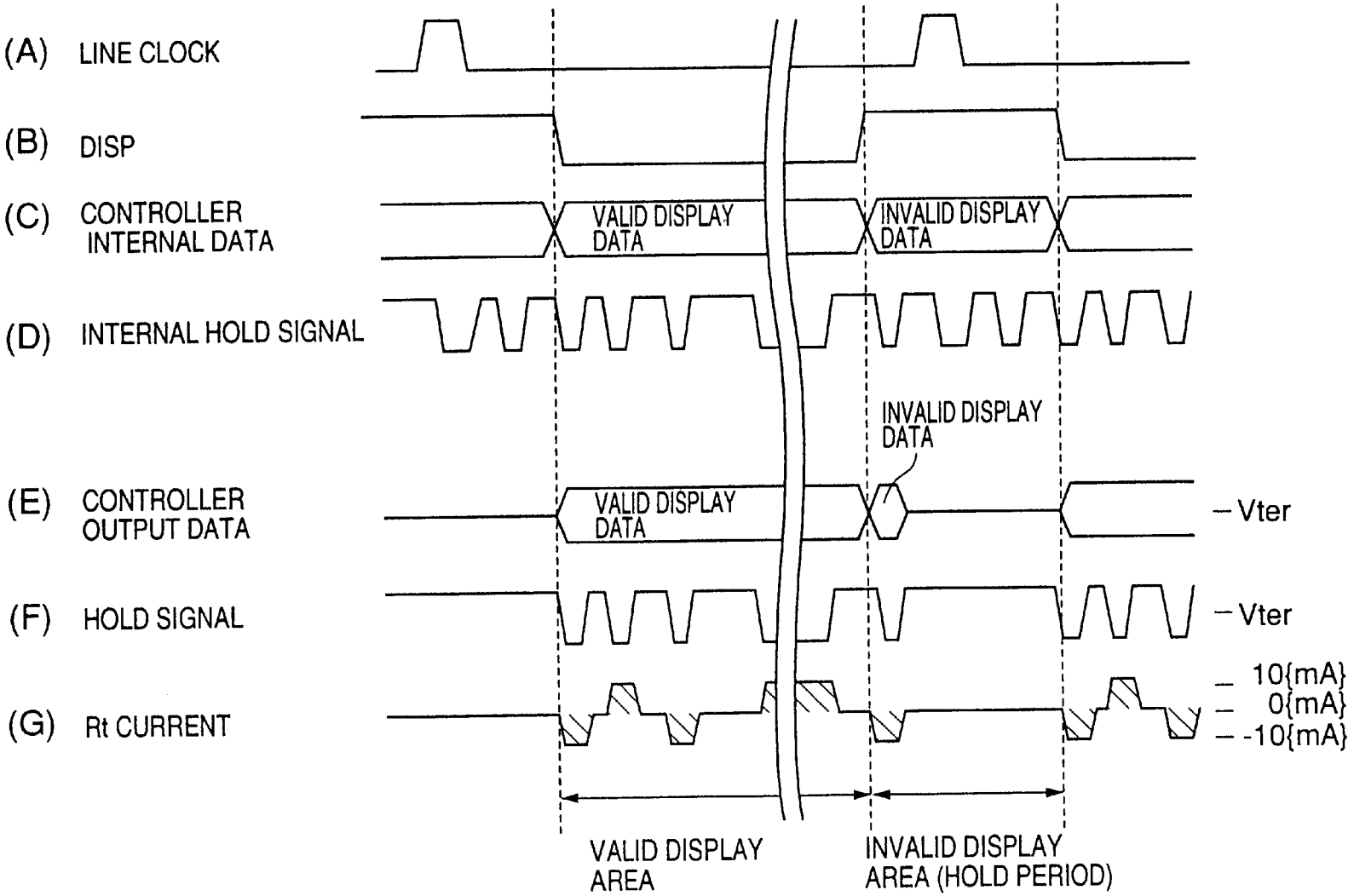
FIG. 12 is a timing chart showing the operation of the liquid crystal display device using the data transfer circuit according to the fourth embodiment of the present invention.

FIG. 11 shows the overall constitution of the liquid crystal display device using the data transfer circuit according to this embodiment, and FIG. 12 shows the operation of the liquid crystal display device according to this embodiment. In FIG. 1, the same elements as shown in FIG. 11 are represented by the same reference numerals.

In FIG. 11, display data displayed on a liquid crystal panel 1000 is transferred to liquid crystal driving circuits 200B-1, . . . , 200B-m through the data signal lines 300 from a controller 100B. Here, the controller 100B corresponds to the data transmission circuit 100 shown in FIG. 1. The controller 100B has the output control circuit 120 shown in FIG. 1, and the hold signal generating circuit 122A shown in FIG. 7 is used as the hold signal generating circuit in the output control circuit 120. Each of the liquid crystal driving circuits 200B-1, . . . , 200B-m corresponds to the data r reception circuit 200 shown in FIG. 1. T he data signal lines 300 are terminated to the terminal voltage Vter by the terminal resistors Rt-1, . . . , Rt-n.

Further, in the controller 200B, an OR circuit OR carries out OR operation between the internal hold signal Hold and a DISP signal indicating a valid period of a display signal to be output. The OR output thus obtained is output through a hold signal output buffer 126B to the hold signal line 400. When the DISP signal is inactive, the hold signal is set to be active, and the data signal lines 300 during an invalid display period are set to the level of the terminal voltage Vter.

Further, the controller 100B outputs a liquid crystal driving circuit control signal 610 to the liquid crystal driving circuits 200B-1, . . . , 200B-m. A liquid crystal scan circuit control signal 620 is input from the controller 100B to the liquid crystal scan circuit 500.

Next, the operation of the liquid crystal display device according to this embodiment will be described.

First, the controller 100B outputs to the data signal lines 300 the display data to be displayed on the liquid crystal panel 1000, whereby the display data is taken into the liquid crystal driving circuits 200B-1, . . . , 200B-m. The liquid crystal driving circuits 200B-1, . . . , 200B-m drive the data lines of the liquid crystal panel 1000 with the voltage corresponding to the display data. Further, the controller 100B provides a control signal 620 such as a line clock or the like to the liquid crystal scan circuit 500, whereby each line of the liquid crystal panel 1000 is scanned and the display data is displayed on the liquid crystal panel 1000.

Here, as shown in (C) of FIG. 12, valid display data to be displayed on the liquid crystal panel and invalid display data which are not displayed on the liquid crystal panel exist in the internal data of the controller 100B. After the valid display data is input to the liquid crystal driving circuit 200B-1, . . . , 200B-m, the line clock is input as shown in (A) of FIG. 12 during the period of the invalid display data.

As shown in (B) of FIG. 12, the DISP signal indicating the valid period of the display data to be output is provided in the controller 100B. Further, as shown in (D) of FIG. 12, the internal hold signal is generated for each of the valid display data and the invalid display data when the same level data is continued and during the period corresponding to the difference between the delay time Td of the delay circuit and the length Tc of the cycle (Tc-Td) as shown in (C) of FIG. 8.

Accordingly, the valid display data is output as shown in (E) of FIG. 12, and at this time the hold signal shown in (F) of FIG. 12 is output, whereby the Rt current is reduced as shown in (G) of FIG. 12. The principle thereof is the same as that described with reference to FIGS. 8 and 9.

Further, the invalid display data is signals in which the same level (for example, "1111 . . . " or "0000 . . . ") is continued. Therefore, in the invalid display data shown in (C) of FIG. 12, when the data is output from the controller, only the data of first one cycle is output as invalid display data as shown in (E) of FIG. 12, and, during the remaining period, the data is held when the hold signal shown in (F) of FIG. 12 becomes active. Accordingly, the Rt current during most of the transmission period of the invalid display data is equal to 0 mA as shown in (G) of FIG. 12, so that the Rt current when the invalid display data is transmitted can be also reduced.

As described above, the current consumption of the terminal resistor Rt can be reduced in the liquid crystal display device using the data transfer circuit of this embodiment. Further, the power consumption of the terminal resistor during the invalid display period can be also reduced.

Next, the constitution and operation of the liquid crystal display device using the data transfer circuit according to a fifth embodiment of the present invention will be described with reference to FIGS. 13 and 14.

Figure 13:
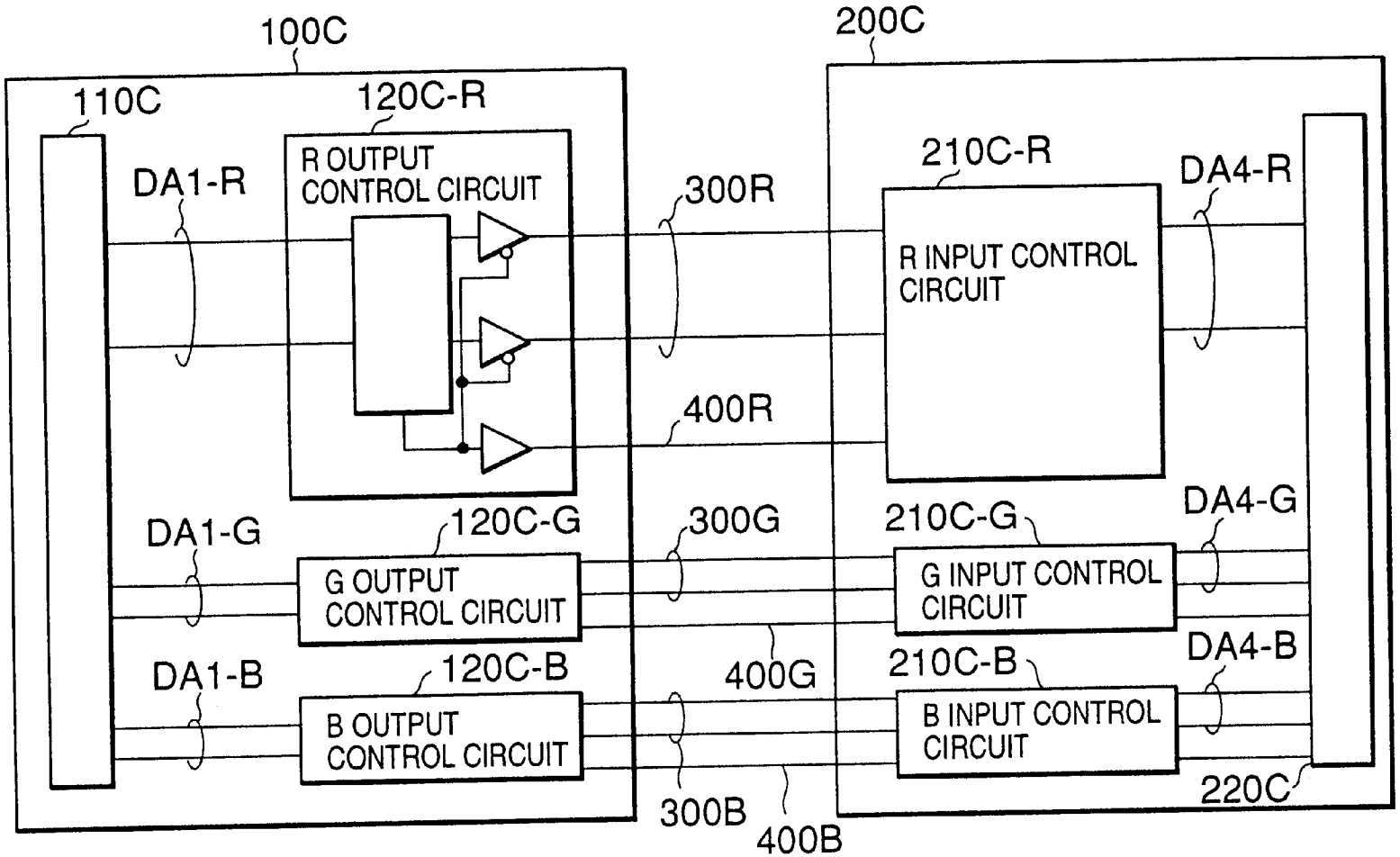
FIG. 13 is a block diagram showing the constitution of a liquid crystal display device using a data transfer circuit according to a fifth embodiment of the present invention.
Figure 14:
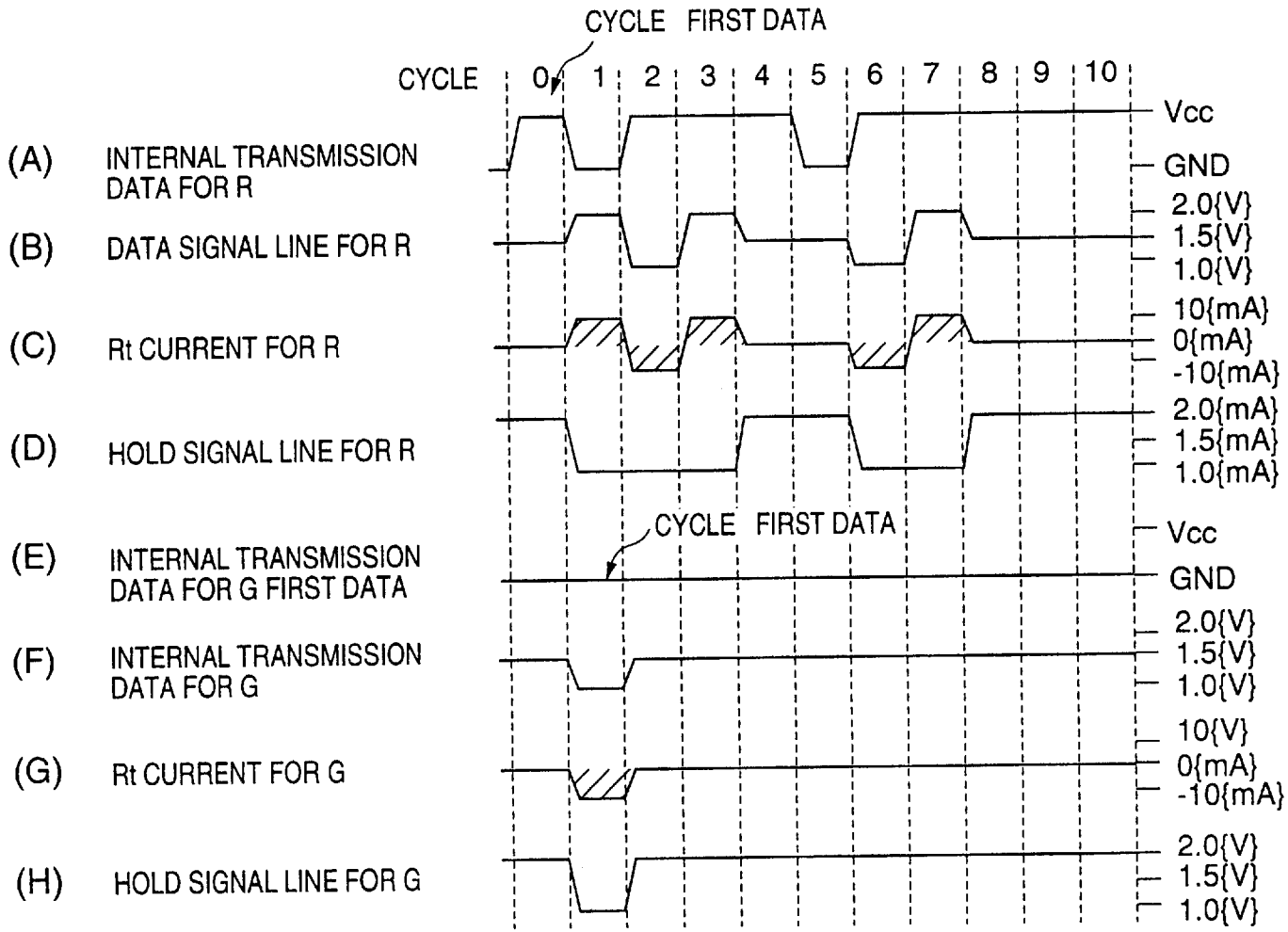
FIG. 14 is a timing chart showing the operation of the liquid crystal display device using the data transfer circuit according to the fifth embodiment of the present invention.

FIG. 13 shows the overall constitution of the liquid crystal display device using the data transfer circuit of this embodiment, and FIG. 14 shows the operation of the liquid crystal display device according to this embodiment. In FIG. 13, the same elements as the embodiment shown in FIG. 1 are represented by the same reference numerals.

In FIG. 13, the liquid crystal panel used in this embodiment is a color liquid crystal panel. Accordingly, the controller 100C includes an internal circuit 100C, and R (Red) output control circuit 120C-R, G (Green) output control circuit 120C-G and B (Blue) output control circuit which output display data of three primary colors (R, G and B), respectively.

The R output control circuit 120C-R outputs display data from data signal lines 300R and also outputs a hold signal Hold from a hold signal line 400R. The G output control circuit 120C-G and the B output control circuit 120C-B have the same constitution as the R output control circuit 120C-R.

The liquid crystal display circuit 200C includes R input control circuit 210C-R, G input control circuit 210C-G and B input control circuit 210C-B for three primary colors of RGB, and an internal circuit 220C.

The display data to be displayed on the liquid crystal panel are transferred to the liquid crystal driving circuit 200C through data signal lines 300R, 300G and 300B from the controller 100C. Here, the controller 100C corresponds to the data transmission circuit 100 shown in FIG. 1. The hold signal generating circuit 122 shown in FIG. 2 is used as a hold signal generating circuit in the output control circuits 120C-R, 120C-G and 120C-B of the controller 100C. The liquid crystal driving circuit 200C corresponds to the data reception circuit 200 shown in FIG. 1. The data signal lines 300R, 300G and 300B are terminated to the terminal voltage by the terminal resistors, although not shown in the figure.

Here, the operation of the liquid crystal display device of this embodiment will be described with reference to FIG. 14. In the following embodiment, it is assumed that red characters are displayed on the black background on the color liquid crystal panel. That is, red display data to be displayed on the color liquid crystal panel is transmitted to the data signal lines 300R of the data signal lines 300R, 300G and 300B for RGB, however, no data is transmitted to the other data signal lines 300G and 300B.

Each of (A) to (D) of FIG. 14 correspond to (A) to (D) of FIG. 6, respectively. That is, with respect to R signals, when internal transmission data shown in (A) of FIG. 14 is generated, the same data as the previous data is repeated during the cycles 3, 4, 7 to 10, and thus the R hold signal is active as shown in (D) of FIG. 14. Accordingly, as shown in (B) of FIG. 14, the signal level of the R data signal lines is set to an intermediate level in the cycles 4, 5, 8 to 10, and Rt current for R is equal to 0 mA as shown in (C) of FIG. 14. Therefore, the Rt current can be reduced, and the power consumption can be reduced.

Further, when red characters are displayed on the black background as in the present case, the G internal transmission data is set to 0 level as shown in (E) of FIG. 14. The B internal transmission data is omitted from the illustration because it is also set to 0 level like the G internal transmission data. In the following description, the G internal transmission data and the B internal transmission data have the same behavior. Accordingly, since data after the cycle 1 is equal to the previous data, the G hold signal is active in the cycle 2 and subsequent cycles as shown in (H) of FIG. 14. As a result, as shown in (F) of FIG. 14, the data flowing in the G data signal line is set to a minus level (1.0V) in the cycle 1, and it is set to an intermediate level (1.5V) in the cycle 2 and subsequent cycles. As shown in (G) of FIG. 14, the Rt current for G is equal to 0 mA in the cycle 2 and subsequent cycles. The same is applied to the Rt current for B.

Accordingly, only the R data is varied in a display image of red characters on the black background, and no variation occurs on each of the G and B data. Therefore, the Rt current of G and B can be reduced.

As described above, in the liquid crystal display device using the data transfer circuit according to this embodiment, the current consumption of the terminal resistor Rt can be reduced. In addition, the Rt current in the case of displaying on a color liquid crystal panel can be further reduced.

Figure 15:
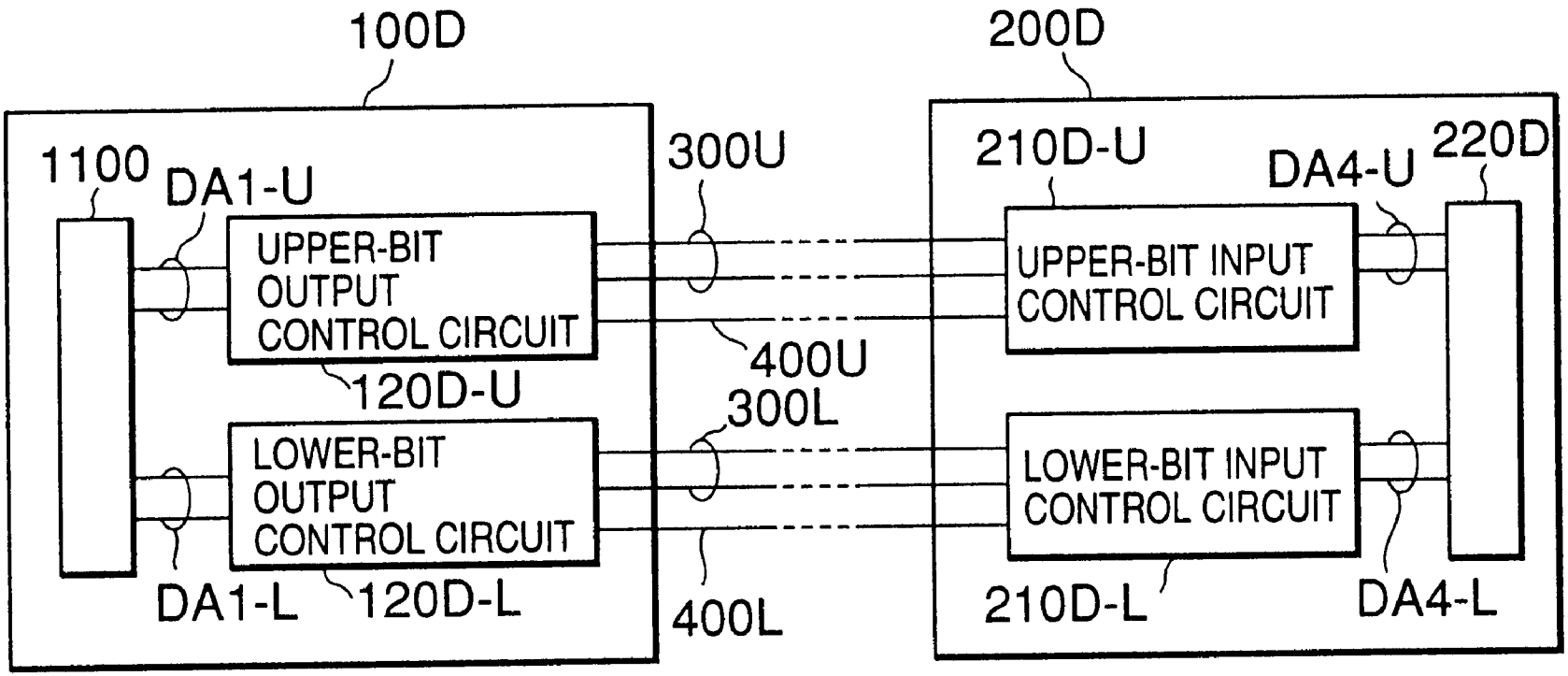
FIG. 15 is a block diagram showing the constitution of a liquid crystal display device using a data transfer circuit according to a sixth embodiment of the present invention.

Next, the constitution of the liquid crystal display device using the data transfer circuit according to a sixth embodiment of the present invention will be described with reference to FIG. 15. In FIG. 15, the same elements as shown in FIG. 1 are represented by the same reference numerals.

In this embodiment, the controller 100D includes an internal circuit 110D, an output control circuit 120D-U for upper bits and an output control circuit 120D-L for lower bits. The upper-bit output control circuit 120D-U outputs display data from the data signal lines 300U, and outputs the hold signal from the hold signal line 400U. The lower-bit output control circuit 120D-L has the same constitution.

The liquid crystal driving circuit 200D includes an upper-bit input control circuit 210D-U, a lower-bit input control circuit 210D-L and an internal circuit 220D. The display data to be displayed on the liquid crystal panel is transferred from the controller 100D through the data signal lines 300U, 300L to the liquid crystal driving circuit 200D. The controller 100D corresponds to the data transmission circuit 100 shown in FIG. 1. The hold signal generating circuit 122 shown in FIG. 2 is used as an internal hold signal generating circuit for the output control circuits 120D-U, 120D-L of the controller 100D. The liquid crystal driving circuit 200D corresponds to the data reception circuit 200 shown in FIG. 1. The data signal lines 300U, 300L are terminated to the terminal voltage by the terminal resistors, although not shown in the figure.

The operation of the liquid crystal display device according to this embodiment will be described.

In this embodiment, the output control circuits 120D-U, 120D-L, the hold signal lines 300U, 300L and the input control circuits 210D-U, 210D-L are individually provided in connection with the upper bits and the lower bits. Accordingly, when the display data of an image having an area in which data to be transmitted are varied, however, the variation amount is small, for example, such a natural image in which only the data of lower bits are varied, however, the data of upper bits are not varied, are transmitted from the controller 100D to the liquid crystal driving circuit 200D, the Rt current of the upper bits can be reduced.

A plurality of output control circuits, hold signal lines and input control circuits are provided in accordance with the local variation amount of the data of the display image as described above, whereby the power consumption can be reduced.

As described above, in the liquid crystal display device using the data transfer circuit of this embodiment, the current consumption of the terminal resistor Rt can be reduced. Further, when an image having a small data variation amount is displayed, the Rt current can be further reduced.

Each of the embodiments of the present invention has been described.

The present invention is not limited to the above-described embodiments, and various modifications may be made without departing from the subject matter of the present invention. For example, the hold signal Hold of the first embodiment is generated by comparing the data one cycle before and the base data with each other, however, the comparison data of the present invention is not limited to data prior to one cycle to obtain the same effect insofar as the data can be latched by the hold circuit.

Further, each of the output control circuits, the hold signal lines and the input control circuits of the fifth embodiment may be individually provided while each of R, G, B as in the case of the fourth embodiment is shared to the upper bits and the lower bits.

Further, in the above-described embodiments, it is assumed that the 3-state output buffer and the hold output buffer are designed as a push-pull type buffer and the terminal voltage Vter is transmitted with signal amplitude of ±0.5V with the terminal voltage Vter at the center of the variation range. However, the present invention is not limited to this mode. For example, even when these buffers are designed as an open drain type buffer such as GTL or the data is transmitted by two differential signal lines, the power consumption of the terminal resistors can be reduced.

As described above, according to the present invention, in the data transfer device and the liquid crystal display device using the data transfer device, the power consumption of the data bus which is terminated by the terminal resistor can be reduced.

What is claimed is:

1. A data transfer device having a data transmitter and a data receiver which are connected to each other by a plurality of data signal lines, each data signal line being terminated by a terminal resistor, wherein:

said data transmitter includes hold signal generating means for generating a hold signal which becomes valid when data to be transmitted is equal to data one cycle before, and stops the data transmission on the basis of the hold signal and transmits the hold signal to said data receiver; and said data receiver includes hold means for holding the data thus received, and stops the reception of the data from said data transmitter on the basis of the hold signal and outputs the data held by said hold means.

2. The data transfer device as claimed in claim 1, wherein said hold signal generating means compares data delayed by a predetermined time with data to be transmitted, and generates the hold signal when these data are coincident with each other.

3. A liquid crystal display device including a controller and a liquid crystal driving device which are connected to each other by a plurality of data signal lines, and a liquid crystal panel which is driven by said liquid crystal driving device to display information, each of said data signal lines being terminated by a terminal resistor, wherein:

said controller includes hold signal generating means for generating a hold signal which becomes valid when data to be transmitted is equal to data one cycle before, and stops the data transmission on the basis of the hold signal and transmits the hold signal to said liquid crystal driving device; and said liquid crystal driving device includes hold means for holding data received, and stops reception of the data from said controller on the basis of the hold signal and outputs the data held by said hold means.

4. The liquid crystal display device as claimed in claim 3, wherein said hold signal generating means compares data delayed by a predetermined time with data to be transmitted, and generates the hold signal when the data are coincident with each other.

5. The liquid crystal display device as claimed in claim 3, wherein said controller transmits first data for invalid display data in valid display data and invalid display data to be transmitted, and stops transmission of remaining data to transmit the hold signal to said liquid crystal driving device.

6. The liquid crystal display device as claimed in claim 3, wherein said controller divides said plural data signal lines into plural sets, and a plurality of said hold signal generating means are provided in correspondence with data to be transmitted on each set of said data signal.

7. A data transfer device comprising:

a data transmitter;

a data receiver;

a plurality of data signal lines which connect the data transmitter to the data receiver; and a plurality of terminal resistors, each of the terminal resistors terminating a respective one of the data signal lines;

wherein the data transmitter includes a hold signal generating circuit which generates a hold signal which becomes valid when data to be transmitted is equal to data to be transmitted one data transmission cycle before;

wherein when the hold signal becomes valid, the data transmitter stops transmitting data to the data receiver and transmits the valid hold signal to the data receiver;

wherein the data receiver includes a hold circuit which holds data received from the data transmitter; and wherein when the data receiver receives the valid hold signal from the data transmitter, the data receiver outputs the data held by the hold circuit.

8. A data transfer device according to claim 7, wherein the hold signal generating circuit delays the data to be transmitted one data transmission cycle before by a predetermined delay time to produce delayed data, compares the data to be transmitted with the delayed data, and generates the valid hold signal when it determines that the data to be transmitted is equal to the delayed data.

9. A data transfer device according to claim 8, wherein the predetermined delay time is one data transmission cycle; and wherein the hold signal generating circuit outputs the valid hold signal one data transmission cycle after it determines that the data to be transmitted is equal to the delayed data.

10. A data transfer device according to claim 8, wherein the predetermined delay time is less than one data transmission cycle; and wherein the hold signal generating circuit outputs the valid hold signal immediately after it determines that the data to be transmitted is equal to the delayed data.

11. A data transfer device according to claim 7, wherein the hold circuit stops receiving signals transmitted through the data signal lines in response to the valid hold signal.

12. A data transfer device according to claim 7, wherein the hold signal generating circuit compares the data to be transmitted with the data to be transmitted one data transmission cycle before, and outputs the valid hold signal one data transmission cycle after the data to be transmitted one data transmission cycle before has been transmitted when it determines that the data to be transmitted is equal to the data to be transmitted one data transmission cycle before.

13. A liquid crystal display device comprising:

a controller;

a liquid crystal driving device;

a liquid crystal panel which is driven by the liquid crystal driving device to display information;

a plurality of data signal lines which connect the controller to the liquid crystal driving device; and a plurality of terminal resistors, each of the terminal resistors terminating a respective one of the data signal lines;

wherein the controller includes a hold signal generating circuit which generates a hold signal which becomes valid when data to be transmitted is equal to data to be transmitted one data transmission cycle before;

wherein when the hold signal becomes valid, the controller stops transmitting data to the liquid crystal driving device and transmits the valid hold signal to the liquid crystal driving device;

wherein the liquid crystal driving device includes a hold circuit which holds data received from the controller; and wherein when the liquid crystal driving device receives the valid hold signal from the controller, the liquid crystal driving device outputs the data held by the hold circuit.

14. A liquid crystal display device according to claim 13, wherein the hold signal generating circuit delays the data to be transmitted one data transmission cycle before by a predetermined delay time to produce delayed data, compares the data to be transmitted with the delayed data, and generates the valid hold signal when it determines that the data to be transmitted is equal to the delayed data.

15. A liquid crystal display device according to claim 14, wherein the predetermined delay time is one data transmission cycle; and wherein the hold signal generating circuit outputs the valid hold signal one data transmission cycle after it determines that the data to be transmitted is equal to the delayed data.

16. A liquid crystal display device according to claim 14, wherein the predetermined delay time is less than one data transmission cycle; and wherein the hold signal generating circuit outputs the valid hold signal immediately after it determines that the data to be transmitted is equal to the delayed data.

17. A liquid crystal display device according to claim 13, wherein data to be transmitted by the controller to the liquid crystal driving device includes valid display data which is to be displayed on the liquid crystal panel, and invalid display data which is not to be displayed on the liquid crystal panel; and wherein when invalid display data is to be transmitted by the controller to the liquid crystal driving device in a plurality of successive data transmission cycles, the controller transmits invalid display data to the liquid crystal driving device in only a first one of the successive data transmission cycles, and transmits the hold signal to the liquid crystal driving device in remaining ones of the successive data transmission cycles.

18. A liquid crystal display device according to claim 13, wherein the controller divides the data signal lines into a plurality of sets of data signal lines;

wherein the controller includes a plurality of hold signal generating circuits respectively corresponding to the plurality of sets of data signal lines; and wherein each of the hold signal generating circuits is a hold signal generating circuit as recited in claim 13 and corresponds to a respective one of the sets of data signal lines.

19. A liquid crystal display device according to claim 13, wherein the hold circuit stops receiving signals transmitted through the data signal lines in response to the valid hold signal.

20. A liquid crystal display device according to claim 13, wherein the hold signal generating circuit compares the data to be transmitted with the data to be transmitted one data transmission cycle before, and outputs the valid hold signal one data transmission cycle after the data to be transmitted one data transmission cycle before has been transmitted when it determines that the data to be transmitted is equal to the data to be transmitted one data transmission cycle before.

* * * * *